US009084044B2

(12) United States Patent
Chen et al.

(10) Patent No.: US 9,084,044 B2
(45) Date of Patent: Jul. 14, 2015

(54) ELECTRONIC DEVICE HAVING MULTI-DIRECTIONAL ADJUSTABLE SPEAKER

(71) Applicant: Wistron Corporation, New Taipei (TW)

(72) Inventors: Hsih-Shuay Chen, New Taipei (TW); Ting-Yao Cheng, New Taipei (TW); Kuei-Yuan Chung, New Taipei (TW); Yao-Wei Wang, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 14/186,321

(22) Filed: Feb. 21, 2014

(65) Prior Publication Data

US 2014/0321689 A1 Oct. 30, 2014

(30) Foreign Application Priority Data

Apr. 29, 2013 (TW) ..... 102115281 A

(51) Int. Cl.

| | |
|---|---|
| ***H04R 5/00*** | (2006.01) |
| ***H04R 5/02*** | (2006.01) |
| ***H04R 1/34*** | (2006.01) |

(52) U.S. Cl.

CPC ..... *H04R 5/02* (2013.01); *H04R 1/345* (2013.01); *H04R 2499/11* (2013.01); *H04R 2499/15* (2013.01)

(58) Field of Classification Search

CPC ..... H04R 1/1033; H04R 1/1058; H04R 1/00
USPC ..... 381/387, 333, 386, 361, 679, 87, 388, 381/152; 361/679, 679.06, 23, 679.2
See application file for complete search history.

(56) References Cited

U.S. PATENT DOCUMENTS

| | | | | |
|---|---|---|---|---|
| 6,302,612 | B1 * | 10/2001 | Fowler et al. | 403/76 |
| 2005/0254679 | A1 * | 11/2005 | Akino | 381/390 |
| 2009/0285438 | A1 * | 11/2009 | Liou et al. | 381/388 |
| 2013/0202147 | A1 * | 8/2013 | Staley et al. | 381/387 |

* cited by examiner

*Primary Examiner* — Curtis Kuntz
*Assistant Examiner* — Julie X Dang
(74) *Attorney, Agent, or Firm* — The Mueller Law Office, P.C.

(57) ABSTRACT

An electronic device includes a main unit having a first housing with a groove and a speaker having a second housing and an adjusting rod. The groove has a limiting section and a stop portion receiving section, a minimum width of which is greater than that of the limiting section. The adjusting rod has a rod body extending through the limiting section, and a stop portion received in and rotatable relative to the stop portion receiving section and having an outer diameter greater than the minimum width of the limiting section. Through the cooperation of the adjusting rod and the groove, the speaker is multi-directionally adjustable relative to the main unit.

19 Claims, 19 Drawing Sheets

ELECTRONIC DEVICE HAVING MULTI-DIRECTIONAL ADJUSTABLE SPEAKER

CROSS-REFERENCE TO RELATED APPLICATION

This application claims priority of Taiwan Patent Application No. 102115281, filed on Apr. 29, 2013.

BACKGROUND OF THE DISCLOSURE

1. Field of the Disclosure

The disclosure relates to an electronic device having a speaker, and more particularly to an electronic device having a multi-directional adjustable speaker.

2. Description of the Related Art

Electronic devices, such as notebook computers, tablet computers, mobile phones, and even displays, all have a speaker built therein. The sound produced by the speaker travels out from a speaker grid of a housing of the electronic device.

However, a speaker of a conventional electronic device is designed to be fixed. That is, the position of the speaker grid of the housing is fixed, and the speaker is placed within the housing and immovably secured to a circuit board of the conventional electronic device. In such a case, when the location of the conventional electronic device is limited by the environment such that the speaker grid is covered up, the sound transmission effect is seriously affected. As a common example, a tablet computer, because of its thin design, typically has its speaker grid provided at a bottom of the housing close to an edge of the housing, and the sound travels out obliquely downwards. As a result, when the tablet computer is laid horizontally on a tabletop, the tabletop blocks the sound produced by the speaker, resulting in a poor sound effect.

SUMMARY OF THE DISCLOSURE

Therefore, an object of the present disclosure is to provide an electronic device having a multi-directional adjustable speaker with an improved sound transmission effect.

According to this disclosure, there is provided an electronic device that includes a main unit and a speaker. The main unit includes a first housing that has a groove. The groove has an opening that is in communication with the outside, a limiting section that extends inwardly from the opening, and a stop portion receiving section that is in communication with the limiting section. A minimum width of the stop portion receiving section is greater than a minimum width of the limiting section. The speaker includes a second housing, a speaker element set that is contained in the second housing, and an adjusting rod that protrudes from the second housing. The adjusting rod has a rod body that extends through the limiting section of the groove of the first housing, and a stop portion that is connected at an end of the rod body, that is received in the stop portion receiving section, and that is rotatable relative to the stop portion receiving section. An outer diameter of the stop portion is greater than the minimum width of the limiting section.

Through the cooperation of the adjusting rod of the speaker and the groove of the main unit, the speaker is multi-directionally adjustable relative to the main unit.

The effect of the present disclosure is that, by using the design of the groove of the main unit housing and the adjusting rod of the speaker, a position and an orientation of the speaker relative to the main unit may be adjusted, so that a sound transmission direction is not fixed/limited, thereby improving a sound transmission effect.

BRIEF DESCRIPTION OF THE DRAWINGS

Other features and effects of the present disclosure will be clearly presented from the following detailed description of embodiments in coordination with the reference drawings, of which.

DETAILED DESCRIPTION OF THE PREFERRED EMBODIMENTS

Figure 1:
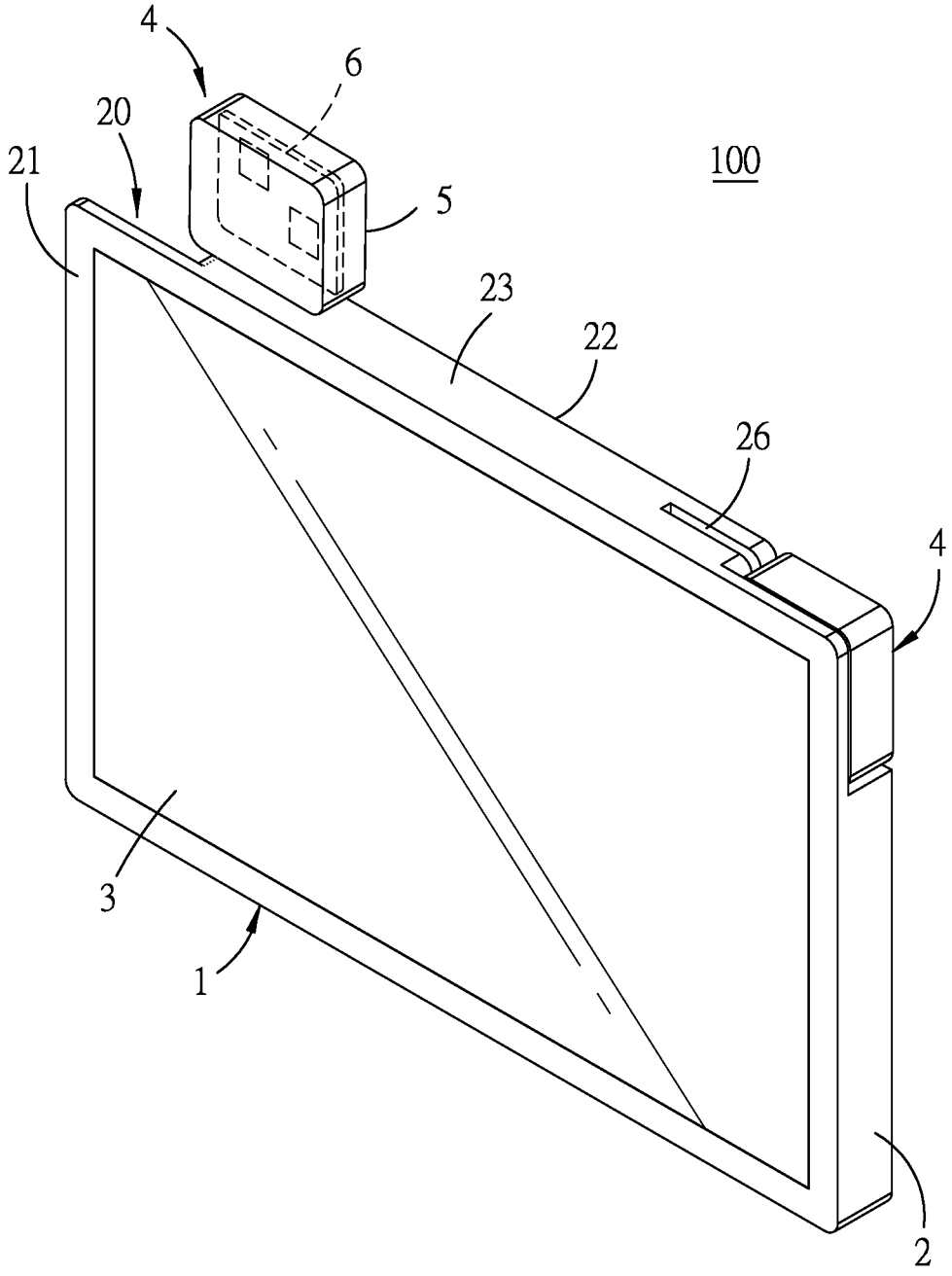
FIG. 1 is an assembled perspective view illustrating a first embodiment of an electronic device as a tablet computer according to the present disclosure from a front point of view, where a second housing of a speaker is moved out of a receiving space of a first housing of a main unit.

Before the present disclosure is described in detail, it should be noted that in the following description, similar elements are designated by the same reference numerals.

Figure 2:
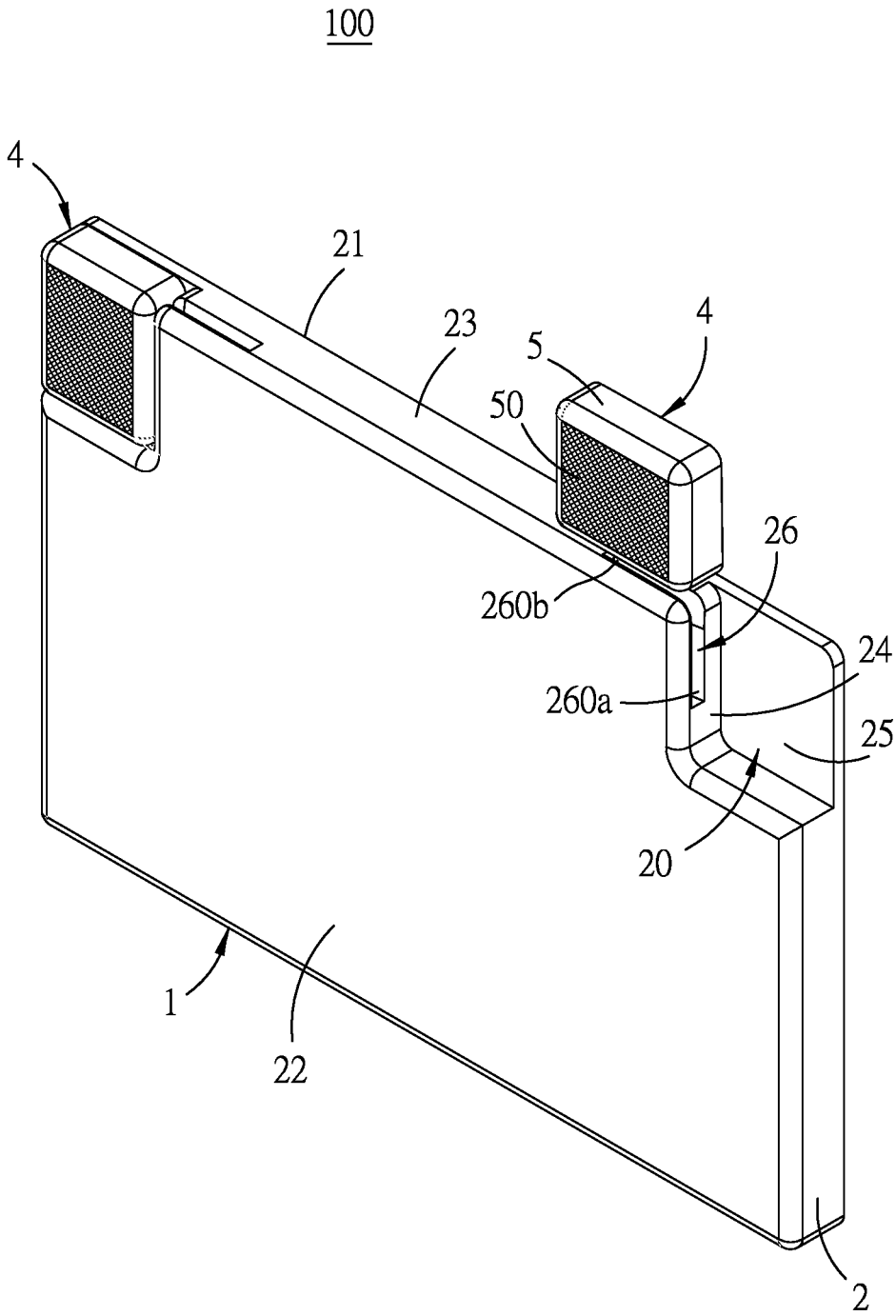
FIG. 2 is an assembled perspective view of the first embodiment from a rear point of view.
Figure 3:
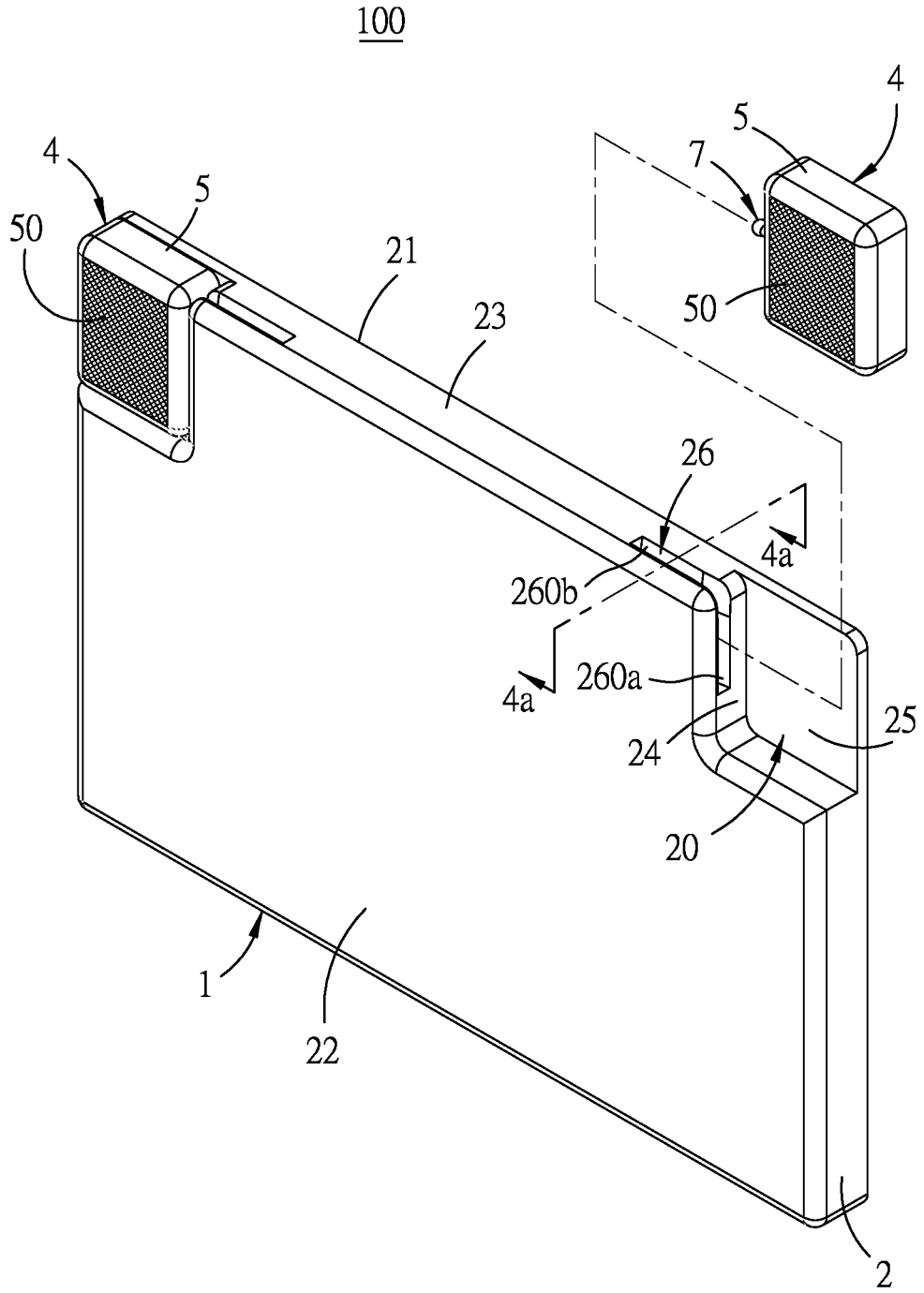
FIG. 3 is a partly exploded perspective view of the first embodiment from the rear point of view.

Referring to FIGS. 1, 2 and 3, a first embodiment of an electronic device 100 according to the present disclosure is exemplified as a tablet computer, which comprises a main unit 1 and two speakers 4 spaced apart from each other in a left-right direction. The quantity and positions of the speakers 4 are not limited to those disclosed in this embodiment, i.e., there may only be a single speaker 4. For simplicity and clarity of description, only one of the speakers 4 (the left one when viewed from the front) of the electronic device 100 and a corresponding structure of the main unit 1 will be described.

The main unit 1 includes a first housing 2, a plurality of electronic elements (not shown in the figures) installed within the first housing 2, and a display panel 3. The first housing 2 has a front section, and a rear section connected to a rear side of the front section and having a recessed structure. The first housing 2 has a front surface 21 located on a front side of the front section and allowing the display panel 3 to be exposed; a rear surface 22 opposite to the front surface 21 and located on a rear side of the rear section; a side surface 23 connecting the front surface 21 and the rear surface 22; a sub-rear surface 25 located at the rear side of the front section, parallel to the front and rear surfaces 21, 22, and corresponding in position to the recessed structure of the rear section; a speaker receiving surface 24 defining the recessed structure of the rear section and connected to the side surface 23, the sub-rear surface 25 and the rear surface 22; and a groove 26 formed in the side surface 23 and the speaker receiving surface 24 at a junction thereof. The side surface 23 and the speaker receiving surface 24 together define a profile of the rear section of the first housing 2. In the embodiment, the speaker 4 is rectangular in shape, and the speaker receiving surface 24 is L-shaped, and together with the sub-rear surface 25, defines a receiving space 20 that matches in shape with the speaker 4 and that is open on three sides for receiving the speaker 4 therein.

Figure 4A:
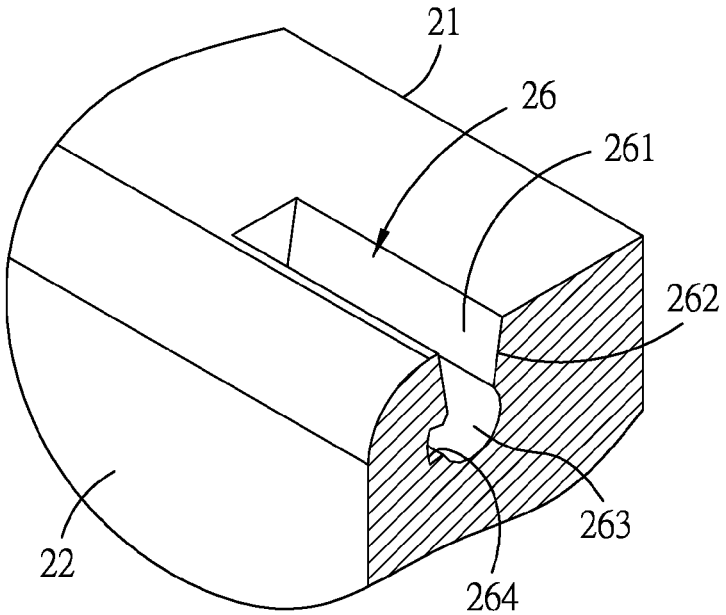
FIG. 4*a* is a fragmentary sectional view taking alone line 4*a*-4*a* of FIG. 3, illustrating a groove of the first housing of the first embodiment.
Figure 4B:
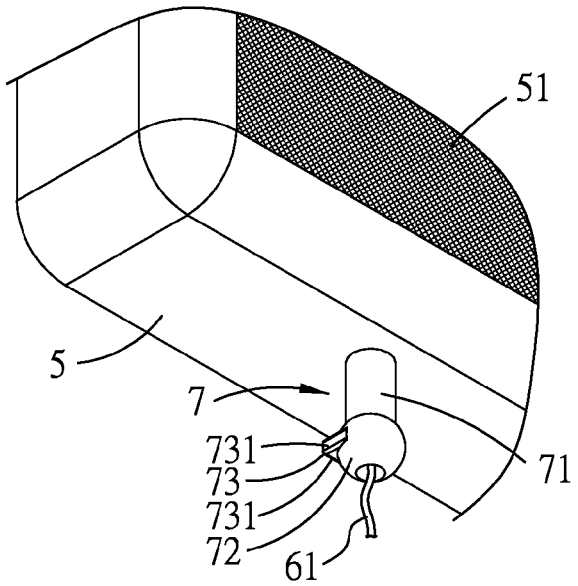
FIG. 4*b* is a fragmentary perspective view of an adjusting rod of the speaker of the first embodiment.
Figure 6:
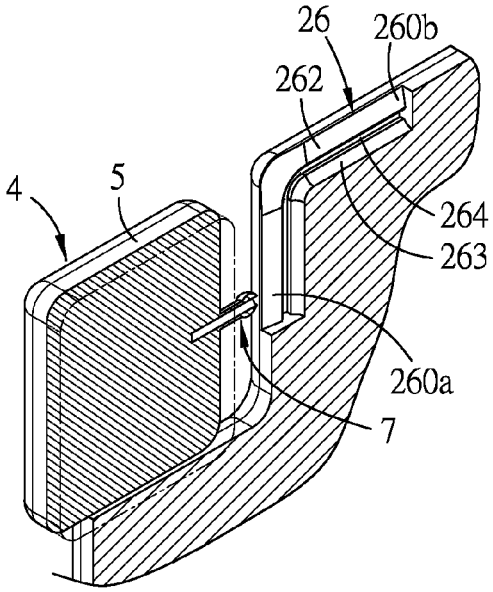
FIG. 6 is a fragmentary partly sectional schematic view, illustrating the groove of the first embodiment by cutting the groove longitudinally.

Referring to FIGS. 3, 4*a* and 6, the groove 26 extends along the side surface 23 and the speaker receiving surface 24 into an L shape, and has a first boundary 260*a* at the speaker receiving surface 24 and a second boundary 260*b* at the side surface 23. With respect to across section perpendicular to the extension direction of the groove 26, the groove 26 has an opening 261 in communication with the outside, a limiting section 262 extending inwardly from the opening 261 with a decreasing width, a stop portion receiving section 263 in communication with the limiting section 262, and a limiting block receiving section 264 in communication with the stop portion receiving section 263 and extending in a lateral direction. The function of the limiting block receiving section 264 will be described later. The stop portion receiving section 263 according to this embodiment has a generally circular cross section, and a minimum width that is greater than a minimum width of the limiting section 262.

Referring to again to FIGS. 1, 2, 3 and 4*b*, the speaker 4 includes a second housing 5, a speaker element set 6 contained in the second housing 5, and an adjusting rod 7 protruding from the second housing 5. The second housing 5 has a speaker grid 50. The adjusting rod has a rod body 71 that is movable between the first boundary 260*a* and the second boundary 260*b* of the groove 26 to cause the second housing 5 to move between a received position (see the state of the speaker 4 to the left on FIG. 2) and an exposed position (see the state of the speaker 4 to the right on FIG. 2). Referring to FIG. 6, in the received position, the second housing 5 is received in the receiving space 20 and is adjacent to the first boundary 260*a* of the groove 26. Referring to FIG. 2, in the exposed position, the second housing 5 is adjacent to the second boundary 260*b* of the groove 26. More particularly, when the second housing 5 of the speaker 4 is in the received position, the rod body 71 of the adjusting rod 7 is located at the first boundary 260*a* of the groove 26 of the first housing 2, such that the second housing 5 is adjacent to the first boundary 260*a*, and such that the speaker grid 50 and the rear surface 22 of the first housing 2 face the same direction (hereinafter referred to as backwards). As the rod body 71 of the adjusting rod 7 of the speaker 4 moves along the L-shaped groove 26 from the first boundary 260*a* toward the second boundary 260*b*, the second housing 5 is moved toward the second boundary 260*b* relative to the first housing 2 of the main unit 1 and is moved out of the receiving space 20 through the change in orientation of the rod body 71 of the adjusting rod 7, in which case the facing direction of the speaker grid 50 of the second housing 5 is adjustable (to be described later).

Referring to FIGS. 4*a*, 4*b*, 5, 6 and 7*a*, in this embodiment, the rod body 71 of the adjusting rod 7 extends through the limiting section 262 of the groove 26 of the first housing 2. The adjusting rod 7 further has a stop portion 72 connected at an end of the rod body 71, received in the stop portion receiving section 263, and rotatable relative to the stop portion receiving section 263, and a limiting block 73 protruding radially from the stop portion 72. An outer diameter of the stop portion 72 is greater than the minimum width of the limiting section 262 of the groove 26. In this embodiment, the rod body 71 is hollow and cylindrical, and the stop portion 72 is hollow and spherical and is in communication with an inner space of the rod body 71. The limiting block 73 is in a shape of a beak and has two limiting faces 731 extending from the stop portion 72 tangential to the surface of the stop portion 72 and intersecting each other. Through the design of the ball-shaped stop portion 72, the adjusting rod 7 of the speaker 4 is rotatable about an axis of the rod body 71 in a stepless manner, is movable within the groove 26 from the first boundary 260*a* to the second boundary 260*b*, and is inclinable relative to the opening 261 of the groove 26 within a width range of the groove 26 in a stepless manner; and through the design of the hollow rod body 71 and the hollow stop portion 72, a cable 61 of the speaker element set 6 of the speaker 4 can extend through the adjusting rod 7.

Figure 7A:
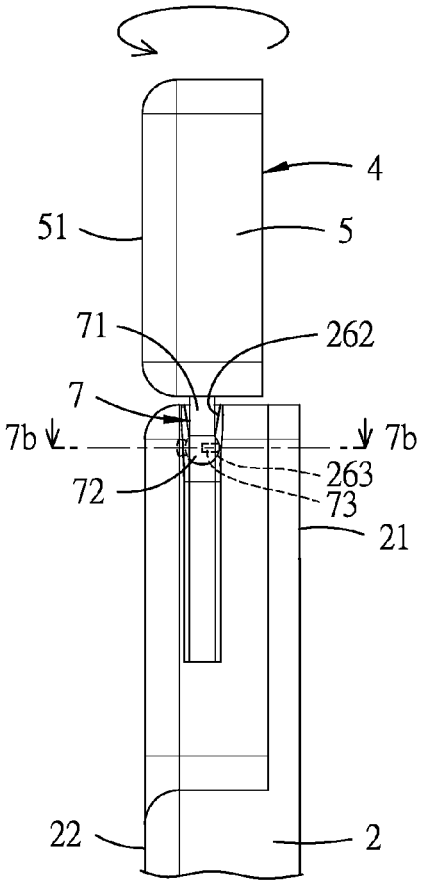
FIG. 7*a* is a fragmentary side schematic view corresponding to FIG. 2, illustrating that the speaker faces backwards initially when removed from the receiving space and is rotatable about the axis of the rod body.
Figure 7B:
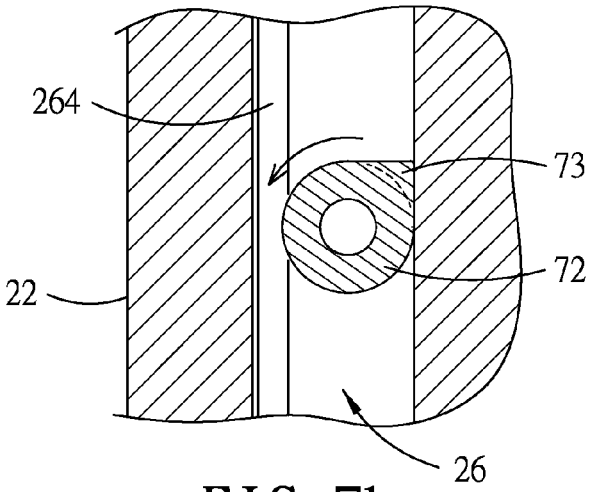
FIG. 7*b* is a fragmentary sectional view taken along line 7*b*-7*b* of FIG. 7*a*, illustrating that one of two limiting faces of a limiting block of the adjusting rod presses against the groove.
Figure 8A:
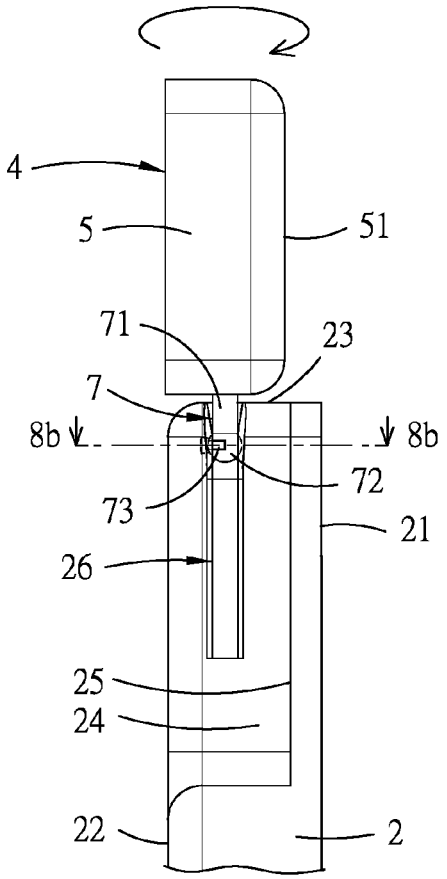
FIG. 8*a* is a view similar to FIG. 7*a*, but illustrating the speaker facing forwards.
Figure 8B:
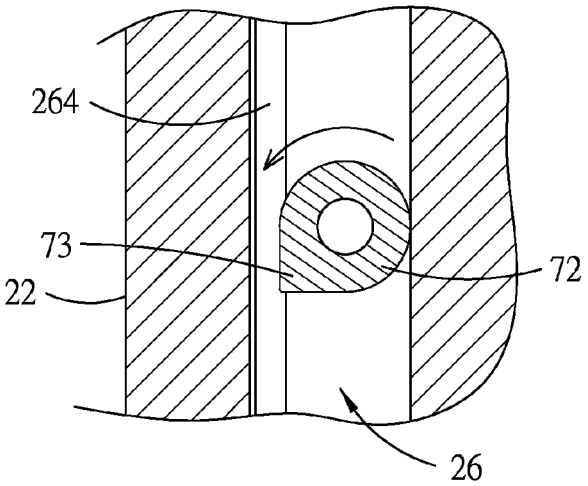
FIG. 8*b* is a fragmentary sectional view taken along line 8*b*-8*b* of FIG. 8*a*, illustrating that the limiting block of the adjusting rod is moved into a limiting block receiving section of the groove.

The second housing 5 of the speaker 4, when moved out of the receiving space 20 and disposed beside the side surface 23 of the first housing 2 of the main unit 1, is free to rotate about the axis of the rod body 71. The limiting block 73 is provided to prevent the speaker 4 from rotating by more than one cycle, and the limiting block receiving section 264 of the groove 26 is provided in view of the presence of the limiting block 73. In particular, referring to FIGS. 1, 2, 7*a* and 7*b*, when the second housing 5 of the speaker 4 is initially moved out of the receiving space 20, the speaker grid 50 faces backwards, and one of the limiting faces 731 of the limiting block 73 abuts against a surface of the stop portion receiving section 263 of the groove 26. In such case, the second housing 5 is only rotatable counterclockwise in a direction indicated in FIG. 7*b* in order to adjust an orientation of the speaker grid 50. Then, referring to FIG. 8*a* and FIG. 8*b*, when the second housing 5 is rotated to allow the speaker grid 50 (see FIG. 2) to face the same direction as the front surface 21 of the first housing 2 (hereinafter referred to as forwards), the limiting block 73 is partially received in the limiting block receiving section 264 of the groove 26. In such case, the second housing 5 still has about 90 degrees of room to rotate counterclockwise until the other of the limiting faces 731 of the limiting block 73 abuts against the surface of the stop portion receiving section 263 of the groove 26.

Figure 9A:
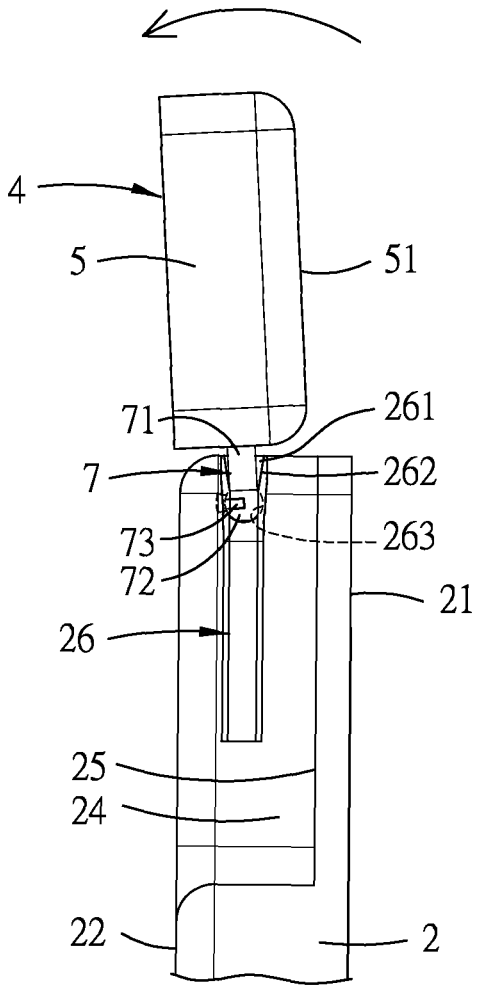
FIG. 9*a* and FIG. 9*b* are views similar to FIG. 8*a*, respectively illustrating that the speaker may incline backwards and forwards.
Figure 9B:
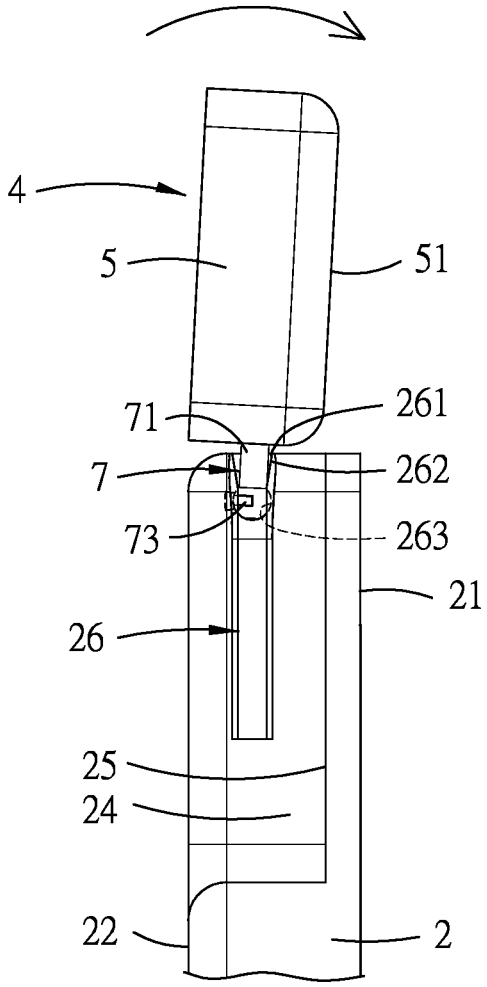

As mentioned above, in addition to the speaker 4 being movable out of the receiving space 20 and rotatable relative to the main unit 1, referring to FIGS. 4*a*, 4*b*, 9*a*, and 9*b*, the speaker 4 is also slightly inclinable relative to the main unit 1. In particular, the limiting section 262 of the groove 26 is fan-shaped in cross section, whose width decreases from the opening 261 toward the stop portion receiving section 263. The limiting block receiving section 264 is also fan-shaped in cross section, with an inwardly decreasing width, where the minimum width is at the junction with the stop portion receiving section 263. Therefore, as shown in FIG. 9*a*, the second housing 5 of the speaker 4 may incline in a direction toward the rear surface 22 of the first housing 2, that is, backwards, until the rod body 71 of the adjusting rod 7 abuts against one side surface of the limiting section 262 of the groove 26. As shown in FIG. 9*b*, the second housing 5 may also incline in a direction toward the front surface 21 of the first housing 2, that is, forwards, until the rod body 71 of the adjusting rod 7 abuts against the other side surface of the limiting section 262 of the groove 26.

Figure 10:
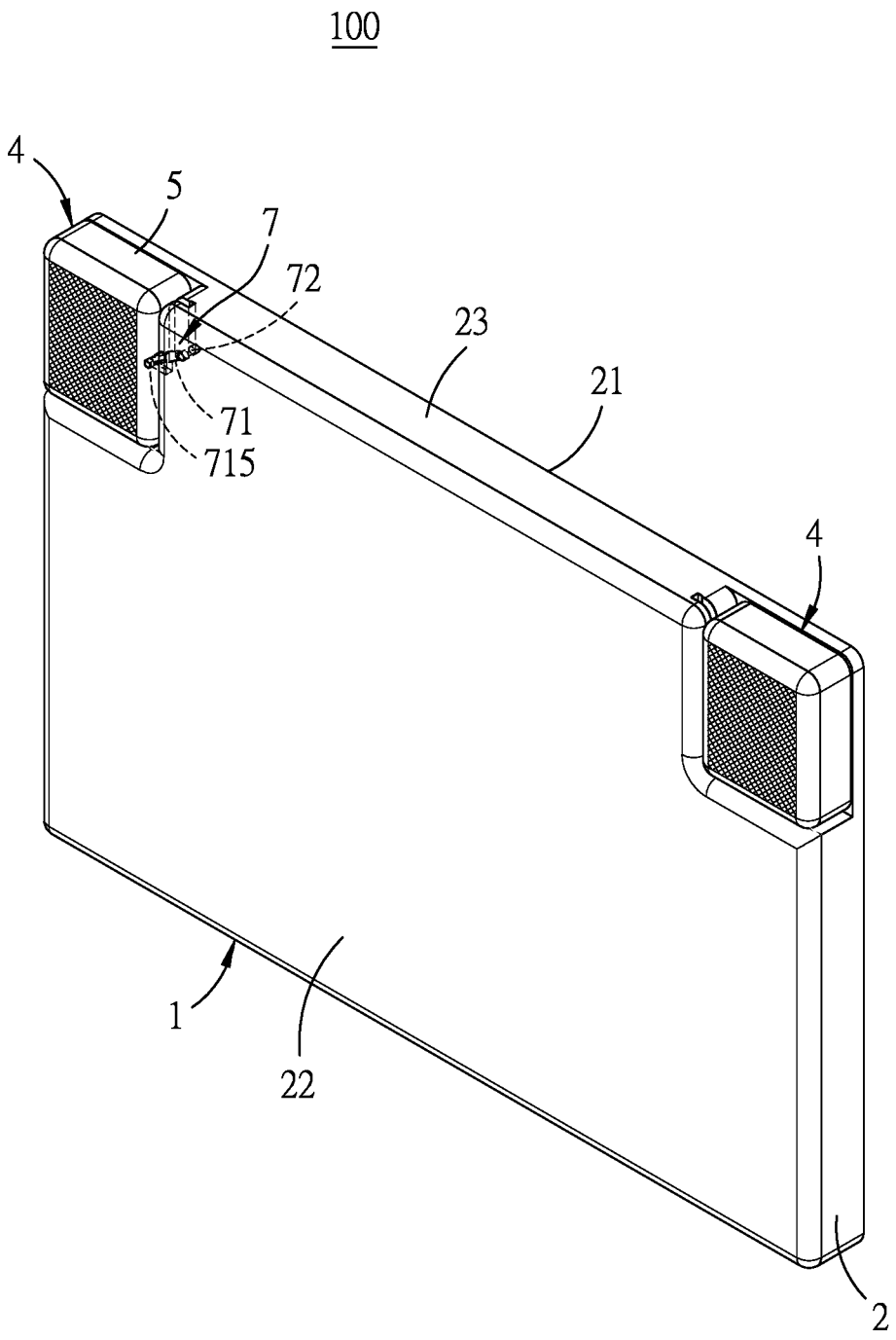
FIG. 10 is an assembled perspective view illustrating a second embodiment of the electronic device according to the present disclosure from a rear point of view, where an adjusting rod of a speaker is indicated using dashed lines.
Figure 11:
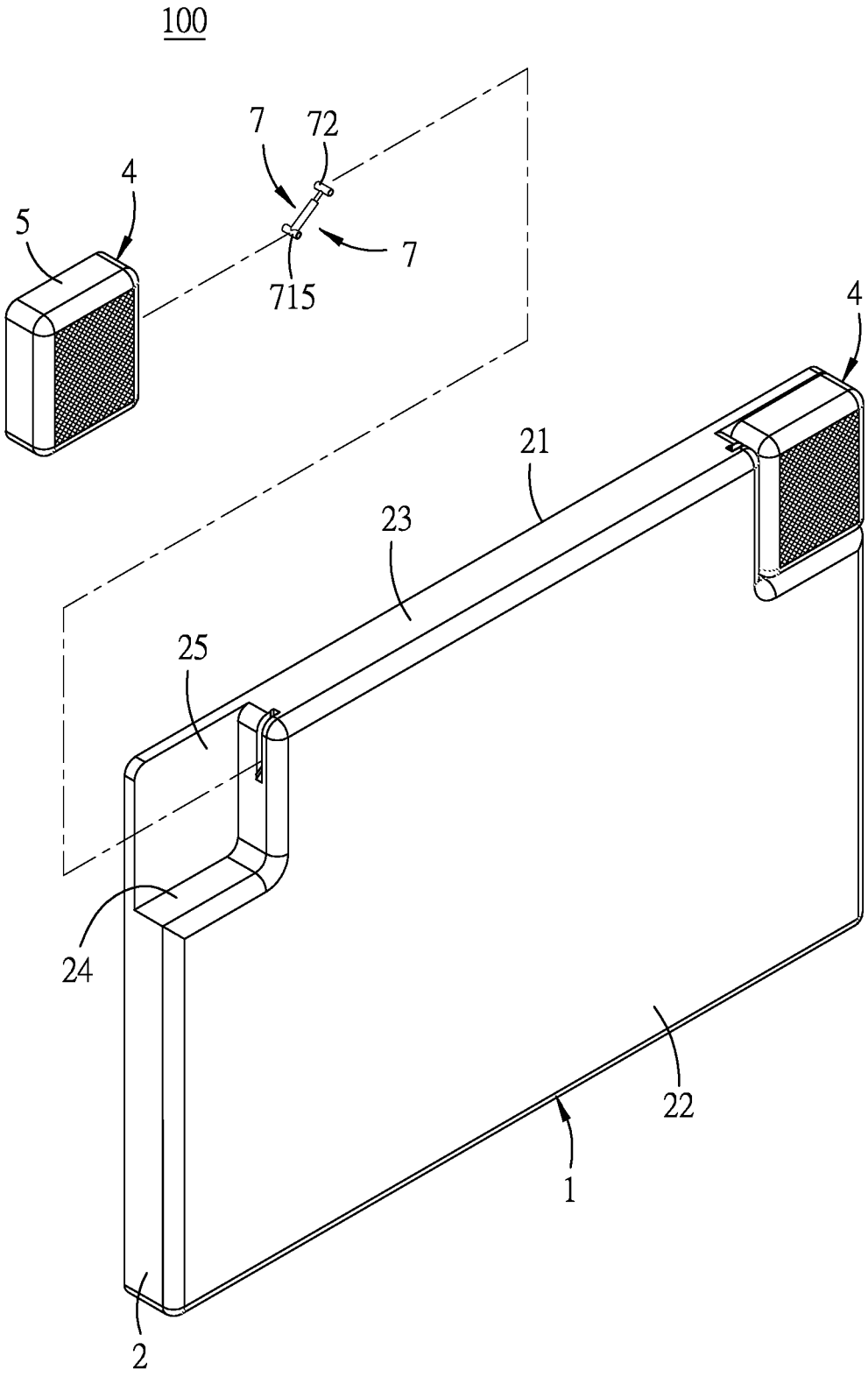
FIG. 11 is a partly exploded perspective view of the second embodiment from another angle of the rear point of view.
Figure 12:
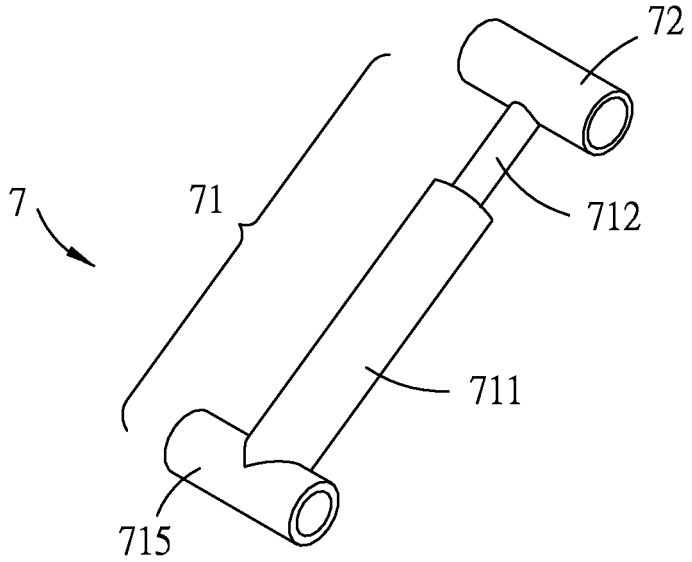
FIG. 12 is an assembled perspective view of the adjusting rod of the second embodiment.
Figure 13:
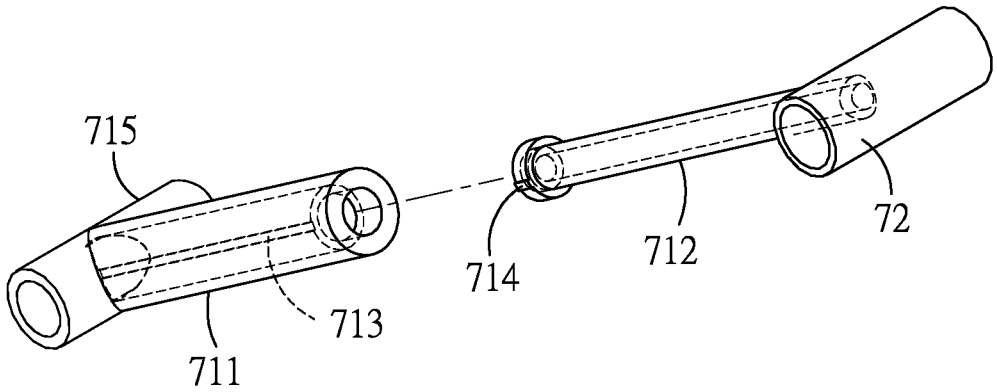
FIG. 13 is an exploded perspective view of the adjusting rod of the second embodiment.
Figure 14:
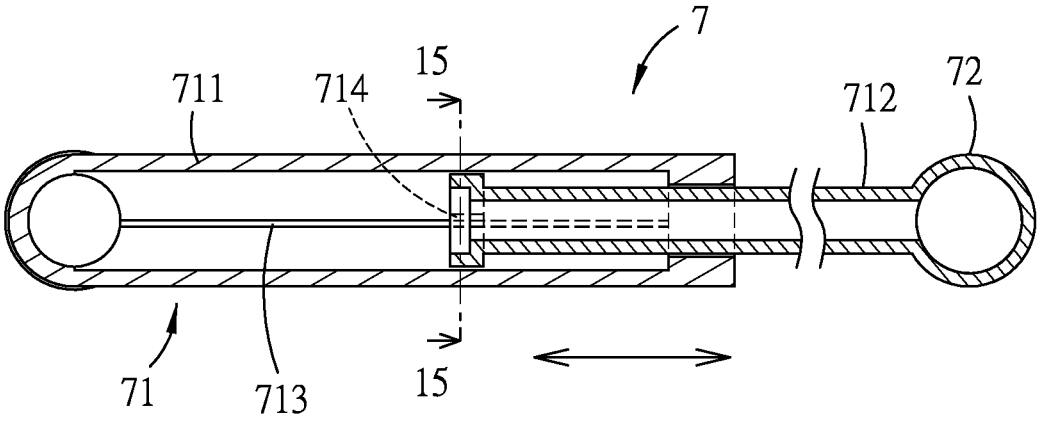
FIG. 14 is a sectional view of the adjusting rod of the second embodiment.
Figure 15:
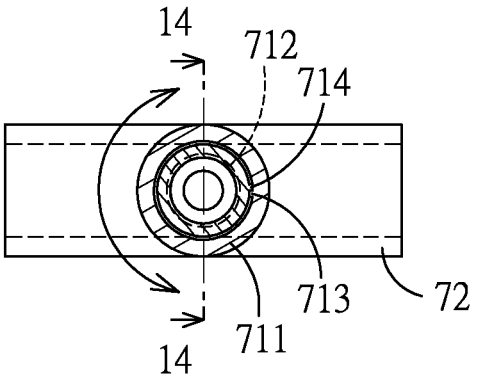
FIG. 15 is a sectional view taken along line 15-15 of FIG. 14.
Figure 16:
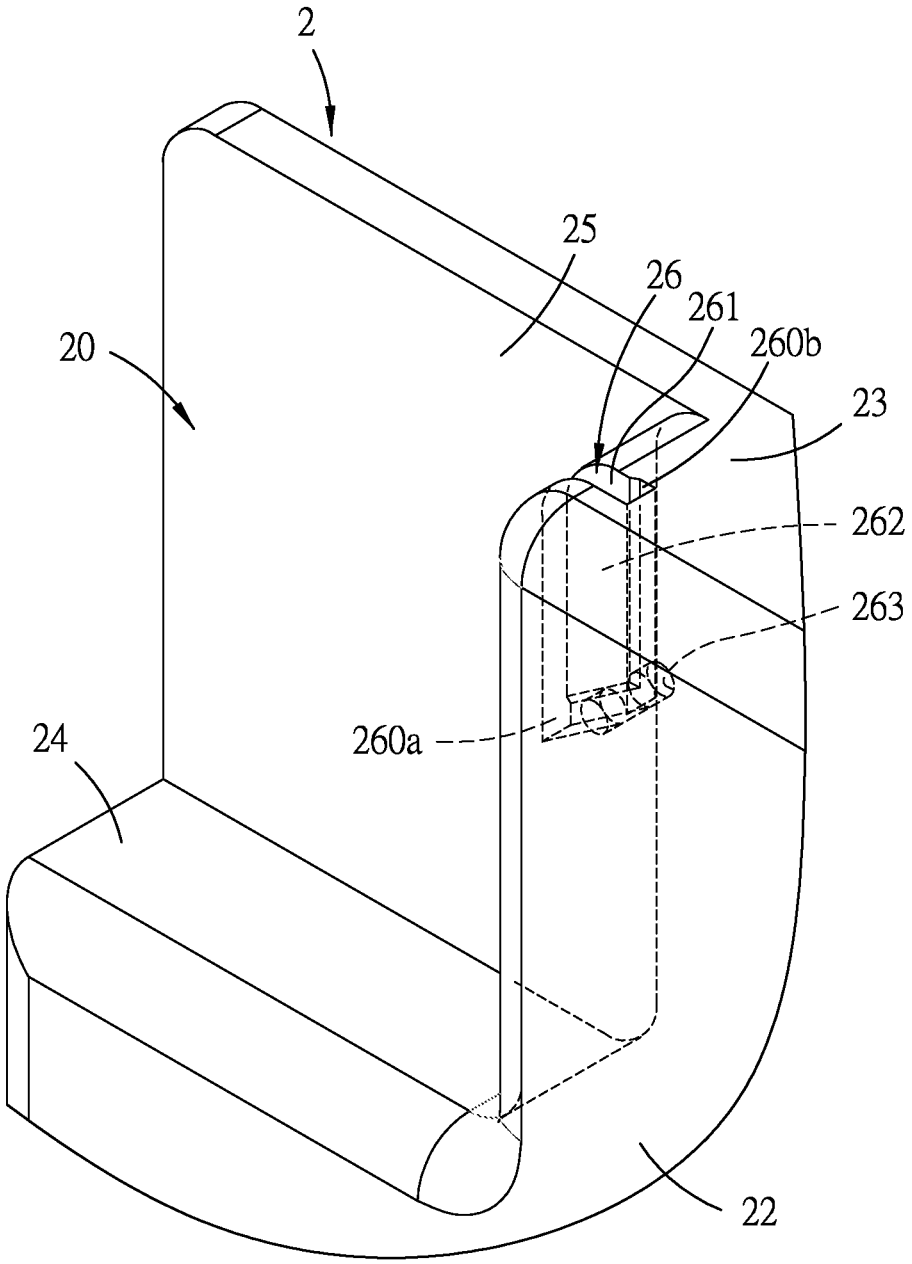
FIG. 16 is a fragmentary perspective view illustrating a groove of a first housing of a main unit in the second embodiment.

FIG. 10 and FIG. 11 illustrate the second embodiment of the electronic device 100 according to the present disclosure, where the difference between the second embodiment and the first embodiment lies in the specific configurations of the adjusting rod 7 of the speaker 4 and of the groove 26 of the first housing 2 of the main unit 1. For clarity of the description, only one of the speakers 4 (the left one when viewed from the rear) of the electronic device 100 and the corresponding structure of the main unit 1 will be described.

Referring to FIGS. 10 to 14, the adjusting rod 7 of this embodiment also protrudes from the second housing 5. However, the rod body 71 is retractable and has a first rod segment 711 that is hollow and cylindrical and that is mounted to the second housing 5, and a second rod segment 712 that is also hollow and cylindrical, that is telescopically and rotatably connected to the first rod segment 711 and that has an end connected to the stop portion 72. The first and second rod segments 711, 712 have intervening ends to prevent departing from each other. Through the design of the rotatable connection between the first rod segment 711 ad the second rod segment 712, the second housing 5 of the speaker 4 of this embodiment is also rotatable about the axis of the rod body 71.

Figure 5:
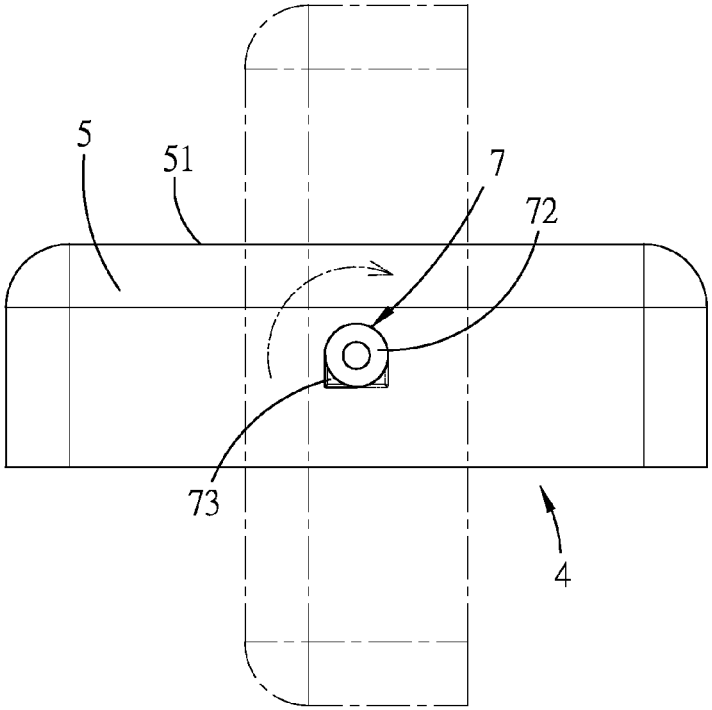
FIG. 5 is a plan view illustrating that the second housing is rotatable about an axis of a rod body of the adjusting rod by at most 270°.

The adjusting rod 7 of the second embodiment has a different shape and operating mechanism from the first embodiment, and has no limiting block 73 (see FIG. 5). In order to prevent the speaker 4 from rotating by more than one cycle, the rod body 71 of the adjusting rod 7 of this embodiment further has a first limiting rib 713 protruding from an inner surface of the first rod segment 711, and a second limiting rib 714 protruding from an outer surface of the second rod segment 712. Thereby, the first rod segment 711 of the rod body 71 is rotatable in a stepless manner by nearly 360 degree relative to the second rod segment 712 within a range of non-intervention between the first limiting rib 713 and the second limiting rib 714.

Referring to FIGS. 10, 12, 16, 17*a* and 17*b*, the stop portion 72 of the adjusting rod 7 is a short circular tube that is perpendicular to the rod body 71 and that extends between the front surface 21 and rear surface 22 of the first housing 2, and the rod body 71 of the adjusting rod 7 is secured inside the second housing 5 by using a pivot axle 715 that is also a short circular tube and that extends in a front-rear direction of the second housing 5. Through the hollow design of the adjusting rod 7, the cable 61 of the speaker element set 6 (see FIG. 1 and FIG. 4*b*) of the speaker 4 can extend through the adjusting rod 7.

Figure 17A:
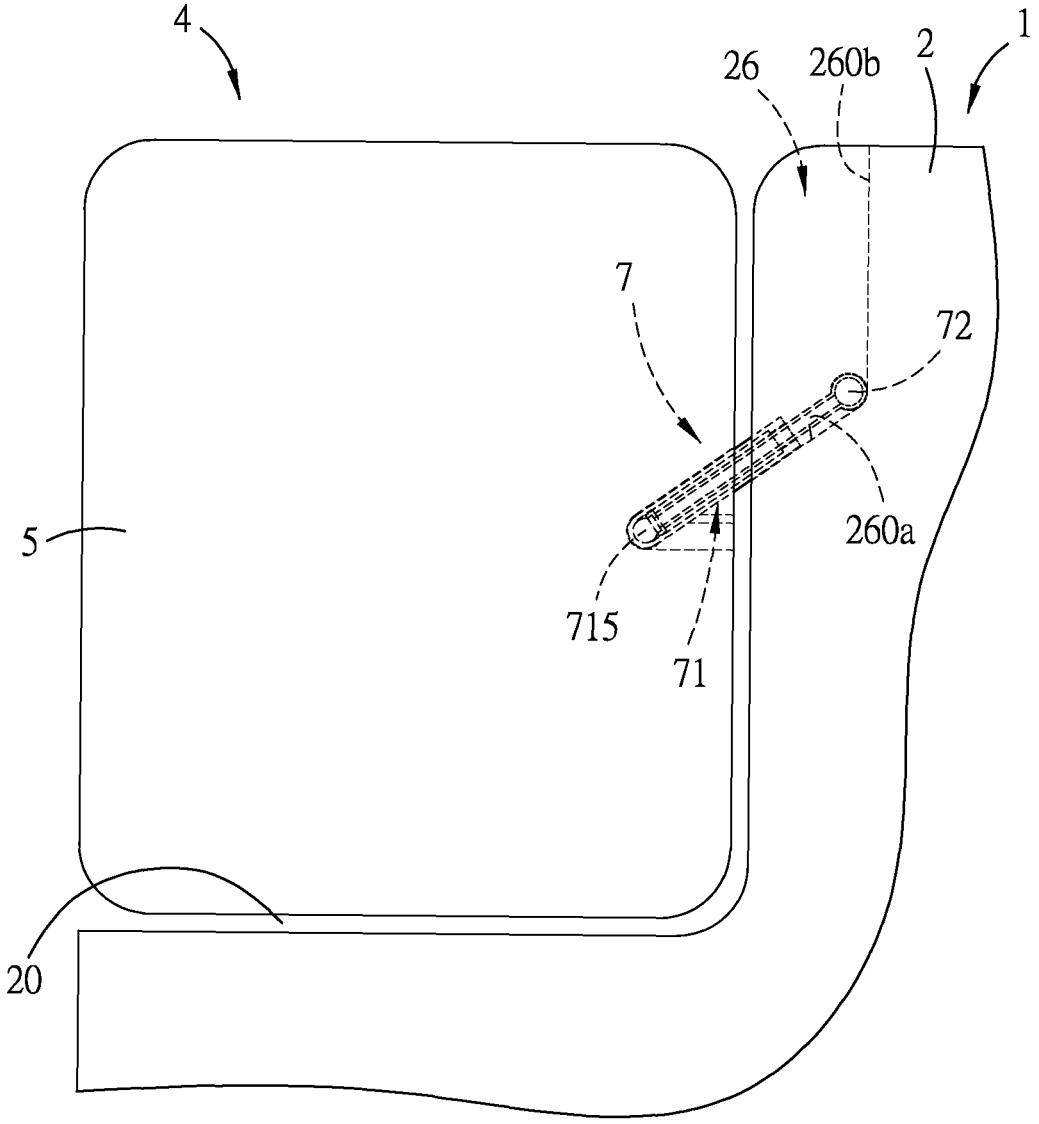
FIG. 17*a* and FIG. 17*b* are schematic views illustrating the adjusting rod of the speaker located respectively at a first boundary and a second boundary of the groove.
Figure 17B:
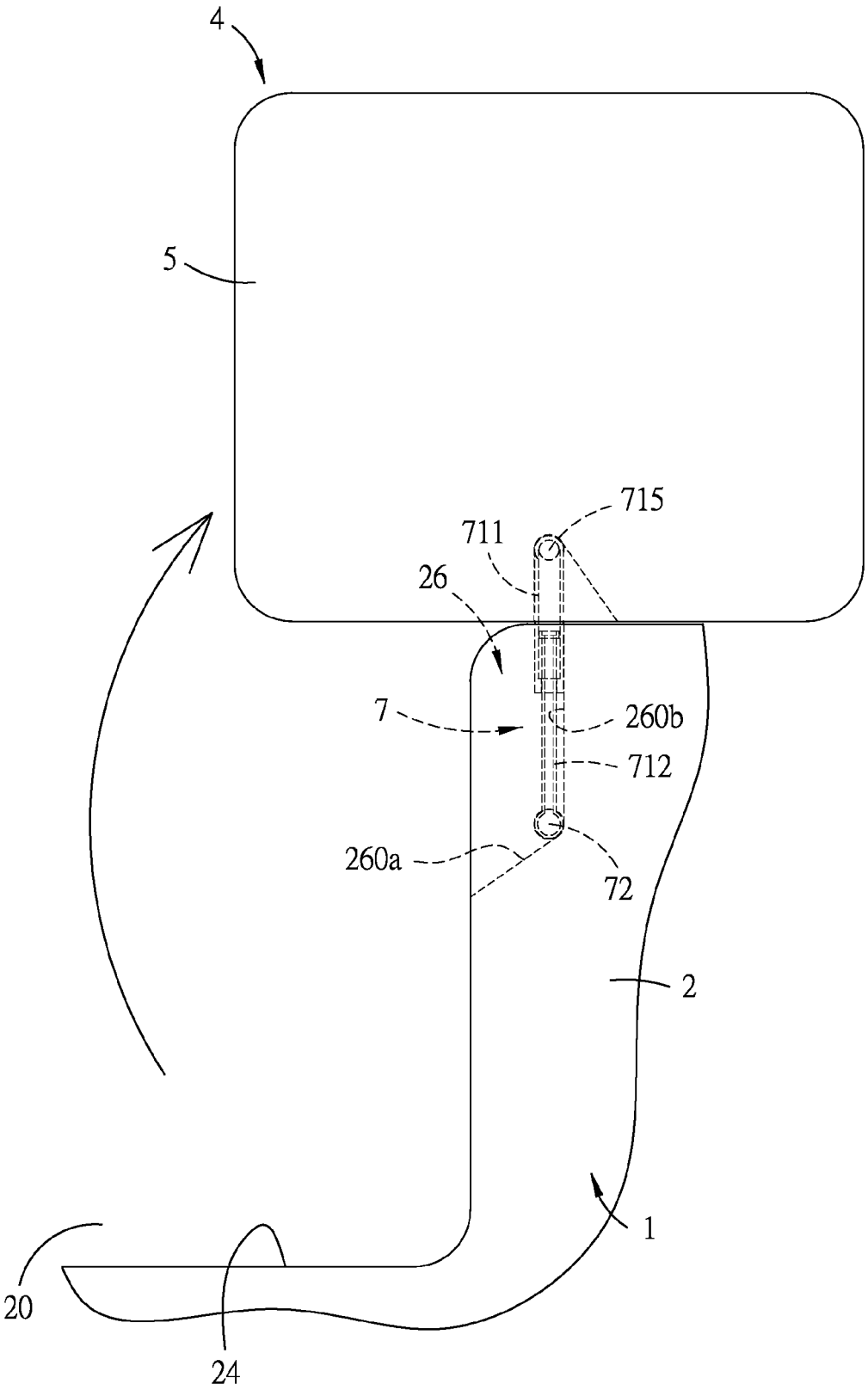

The groove 26 of the first housing 2 of this embodiment is substantially in the shape of a flat cuboid, and also has a limiting section 262 extending inwardly from the opening 261, a stop portion receiving section 263, a first boundary 260*a* at the speaker receiving surface 24 of the first housing 2, and a second boundary 260*b* at the side surface 23. However, the configuration of the stop portion receiving section 263 and the stop portion 72 of this embodiment only permits rotational movement of the stop portion 72 in the stop portion receiving section 263 and not slidable movement along the groove 26. In other words, the adjusting rod 7 may pivot about the stop portion receiving section 263 within a range defined by the first boundary 260*a* and second boundary 260*b* of the groove 26, to cause the second housing 5 to move between the received position, where the second housing 5 is disposed adjacent to the first boundary 260*a* of the groove 26 and the exposed position, where the second housing 5 is disposed adjacent to the second boundary 260*b* of the groove 26. More particularly, when the second housing 5 of the speaker 4 is received in the receiving space 20 and at the received position as shown in FIG. 17*a*, the rod body 71 of the adjusting rod 7 is located at the first boundary 260*a* of the groove 26, such that the second housing 5 is adjacent to the first boundary 260*a* of the groove 26. As the adjusting rod 7 pivots toward the second boundary 260*b*, the second housing 5 departs from the receiving space 20 and moves toward the second boundary 260*b* and changes its orientation relative to the first housing 2 of the main unit 1, as shown in FIG. 17*b*.

Furthermore, the stop portion receiving section 263 of the groove 26 extends slightly in a direction toward the front surface 21 of the first housing 2, so that a width thereof in the front-to-rear direction is slightly greater than that of the stop portion 72 of the adjusting rod 7. The limiting section 262 of the groove 26 also extends slightly in the direction toward the front surface 21 of the first housing 2 at positions close to the first boundary 260*a* and the second boundary 260*b*, so that widths in the front-to-rear direction at such positions are slightly greater than other portions of the limiting section 262. Thereby, when the adjusting rod 7 is pivoted to the first boundary 260*a* or the second boundary 260*b* of the groove 26, the rod body 71 of the adjusting rod 7 may move to abut against the front surface 21 of the first housing 2, thereby achieving a positioning effect. Indeed, the expressions "extends in a direction toward the front surface 21 of the first housing 2" mentioned above all may also be "extends in a direction toward the rear surface 22 of the first housing 2," in which case the rod body 71 of the adjusting rod 7 may lean backwards.

Generally, in this embodiment, through the design of both the stop portion 72 and the pivot axle 715 in the shape of the short circular tubes, the rod body 71 of the speaker 4 is rotatable about the axis of the stop portion 72, and the second housing 5 is pivotable about the pivot axle 715 relative to the rod body 71. Further, in cooperation with the design of the first rod segment 711 and the second rod segment 712 of the rod body 71 of the adjusting rod 7 being rotatable relative to each other, the speaker 4 is multi-directionally adjustable.

Figure 18:
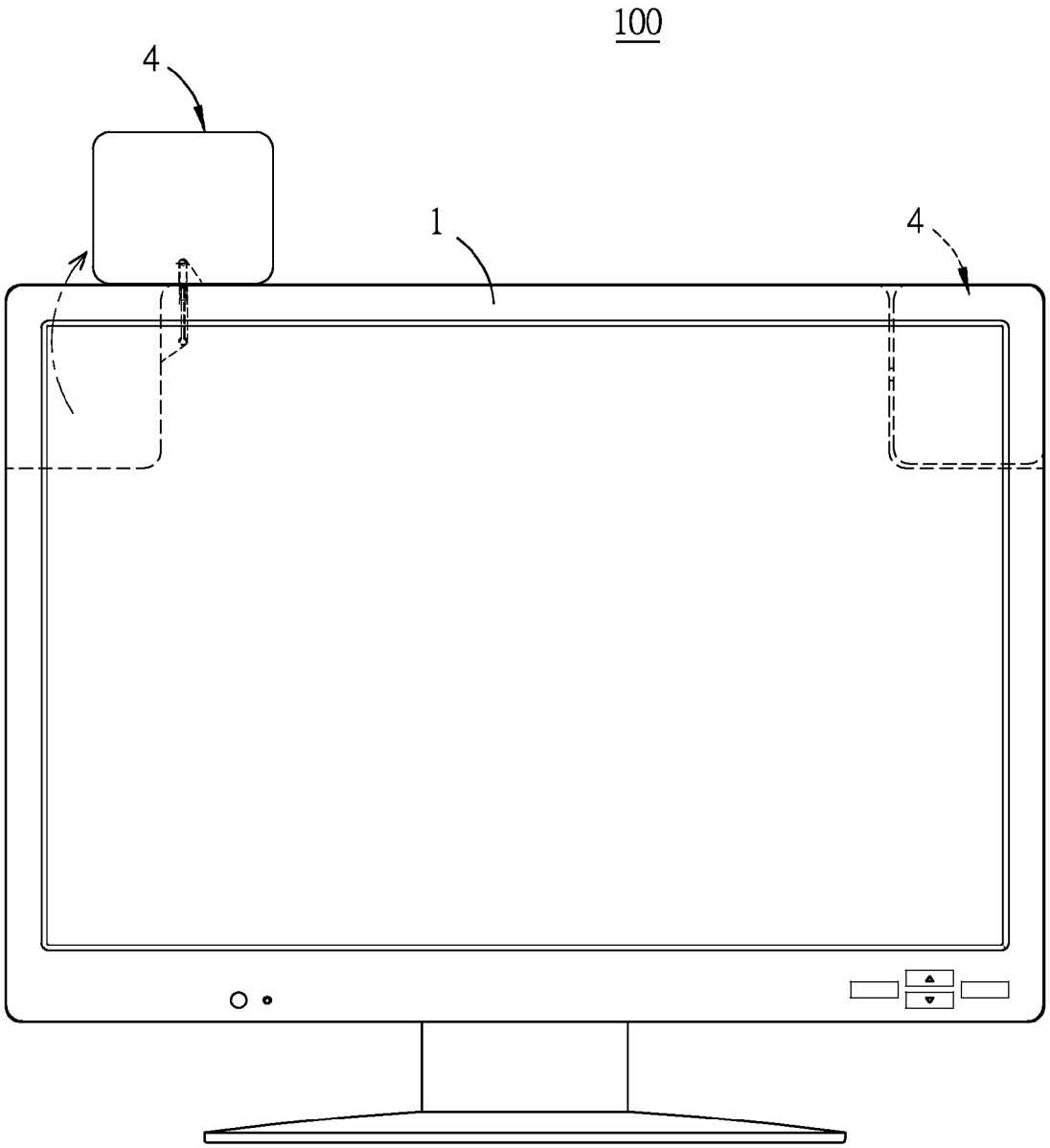
FIG. 18 is a schematic view illustrating that the electronic device of the present disclosure is implemented as a display device.
Figure 19:
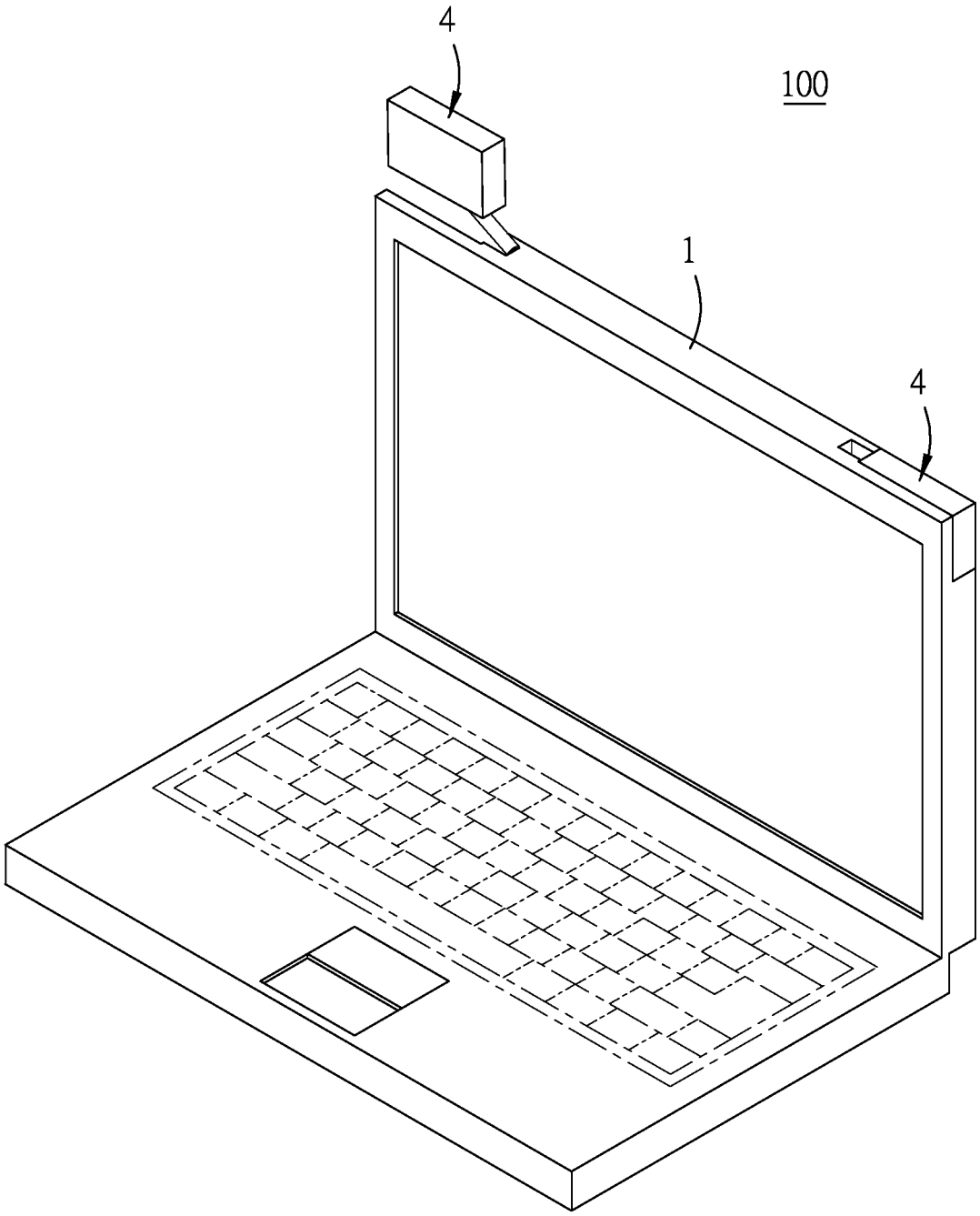
FIG. 19 is a perspective schematic view illustrating that the electronic device of the present disclosure is implemented as a notebook computer.
Figure 20:
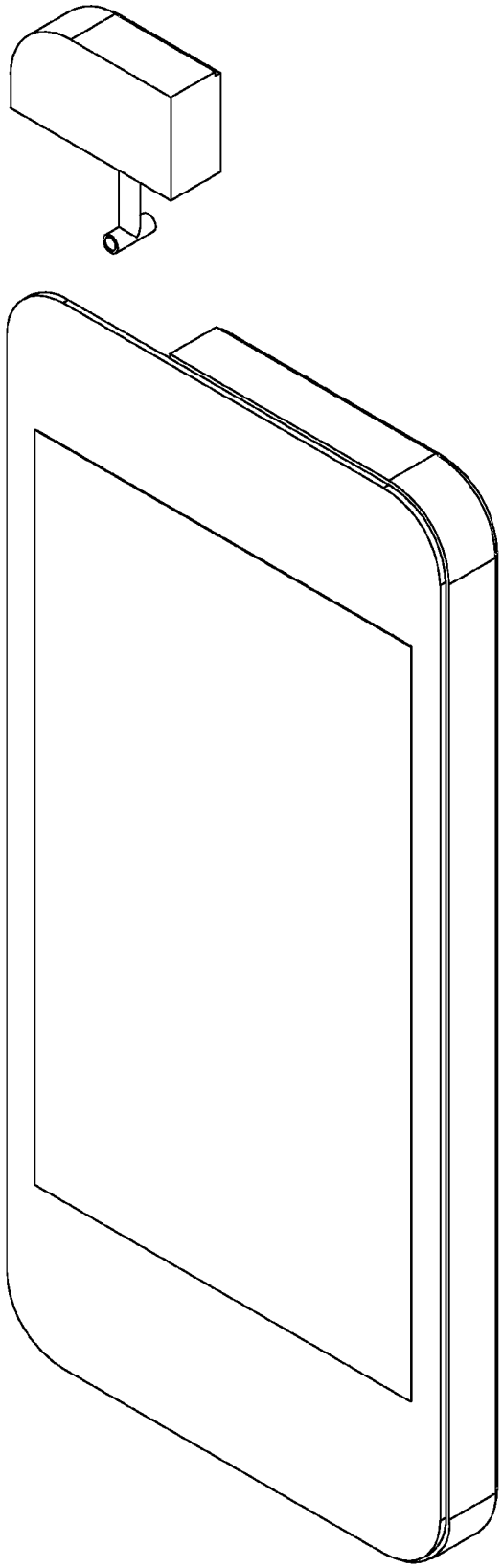
FIG. 20 is an exploded perspective view illustrating that the electronic device of the present disclosure is implemented as a mobile phone.

It is worth mentioning that the electronic device 100 of the present disclosure is not limited to the tablet computer as illustrated in the above embodiments. The electronic device 100 may be any electronic device having a speaker 4, for example, a display device shown in FIG. 18, a notebook computer shown in FIG. 19, or a mobile phone shown in FIG. 20.

To sum up, the present disclosure, by using the design of the groove 26 of the first housing 2 of the main unit 1 in cooperation with the adjusting rod 7 of the speaker 4, allows the orientation of the speaker 4 to be changed relative to the main unit 1 so as to be adaptable to various environments. Thus, the objects of the present disclosure can surely be achieved.

While the present disclosure has been described in connection with what are considered the most practical embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An electronic device, comprising:

a main unit including a first housing that has a groove, said groove having an opening that is in communication with the outside, a limiting section that extends inwardly from said opening, and a stop portion receiving section that is in communication with said limiting section, a minimum width of said stop portion receiving section being greater than a minimum width of said limiting section; and a speaker including a second housing, a speaker element set that is contained in said second housing, and an adjusting rod that protrudes from said second housing, said adjusting rod having a rod body that extends through said limiting section of said groove of said first housing, and a stop portion that is connected at an end of said rod body, that is received in said stop portion receiving section, and that is rotatable relative to said stop portion receiving section, an outer diameter of said stop portion being greater than the minimum width of said limiting section; wherein through the cooperation of said adjusting rod of said speaker and said groove of said main unit, said speaker is multi-directionally adjustable relative to said main unit, wherein said first housing has a recessed structure, a side surface, and a speaker receiving surface connected to said side surface and defining said recessed structure, at least said speaker receiving surface defining a receiving space for receiving said speaker, said groove being disposed at a junction of said side surface and said speaker receiving surface, and having a first boundary at said speaker receiving surface and a second boundary at said side surface; wherein when said second housing of said speaker is received in said receiving space, said rod body of said adjusting rod of said speaker is located at said first boundary of said groove, and as said adjusting rod moves toward said second boundary, said second housing moves relative to said first housing of said main unit and changes an orientation and is removed from said receiving space.

2. The electronic device of claim 1, wherein: said first housing of said main unit has a front section, a rear section connected to a rear side of said front section and having said recessed structure, a front surface located on a front side of said front section and connected to said side surface and allowing a display panel to be exposed, a rear surface opposite to said front surface, connected to said speaker receiving surface and located on a rear side of said rear section, and a sub-rear surface parallel to said front surface and said rear surface, corresponding in position to said recessed structure, and connected to said speaker receiving surface; and said speaker receiving surface and said sub-rear surface cooperatively define said receiving space.

3. The electronic device of claim 2, wherein said speaker element set of said speaker includes a cable, said rod body of said adjusting rod being hollow and cylindrical, and said stop portion being hollow and spherical and being in communication with an inner space of said rod body to permit extension of said cable therethrough, said adjusting rod of said speaker being rotatable about an axis of said rod body and being movable within a range of said groove.

4. The electronic device of claim 3, wherein said adjusting rod of said speaker further has a limiting block protruding radially from said stop portion, said groove of said main unit further having a limiting block receiving section in communication with said stop portion receiving section and receiving movably said limiting block therein, said adjusting rod being rotatable about the axis of said rod body relative to said groove within a range where said limiting block does not abut against a wall of said groove.

5. The electronic device of claim 4, wherein:

said limiting section of said groove of said first housing is fan-shaped in cross section, whose width decreases from said opening toward said stop portion receiving section; and said limiting block receiving section is fan-shaped in cross section, with an inwardly decreasing width where the minimum width is at a junction with said stop portion receiving section.

6. The electronic device of claim 4, wherein said limiting block of said adjusting rod of said speaker has two limiting faces extending from said stop portion tangential to a surface of said stop portion and intersecting each other.

7. The electronic device of claim 2, wherein:

said rod body of said adjusting rod is retractable, and has a first rod segment that is hollow and cylindrical and that is mounted to said second housing, and a second rod segment that is hollow and cylindrical, that is telescopically and rotatably connected to said first rod segment and that has an end connected to said stop portion, such that said second housing of said speaker is rotatable about the axis of said rod body; and said first and second rod segments has intervening ends to prevent departing from each other.

8. The electronic device of claim 7, wherein said rod body of said adjusting rod further has a first limiting rib and a second limiting rib respectively protruding from two surfaces of said first and second rod segments that face each other, such that said first rod segment of said rod body is rotatable relative to said second rod segment within a range of non-intervention between said first limiting rib and said second limiting rib.

9. The electronic device of claim 7, wherein:

said speaker element set of said speaker includes a cable;

said first housing of said main unit further has a front surface to allow a display panel to be exposed, and a rear surface opposite to said front surface and connected to said speaker receiving surface;

said stop portion of said adjusting rod being in a shape of a short circular tube perpendicular to said rod body and that extends between said front surface and said rear surface, such that said rod body is pivotable relative to said first housing of said main unit about an axis of said stop portion.

10. The electronic device of claim 9, wherein said first housing has a recessed structure, a side surface, and a speaker receiving surface connected to said side surface and defining said recessed structure, at least said speaker receiving surface defining a receiving space for receiving said speaker, said groove being disposed at a junction of said side surface and said speaker receiving surface, and having a first boundary at said speaker receiving surface and a second boundary at said side surface;

wherein when said second housing of said speaker is received in said receiving space, said rod body of said adjusting rod of said speaker is located at said first boundary of said groove, and as said adjusting rod pivots toward said second boundary, said second housing moves relative to said first housing of said main unit and changes an orientation and is removed from said receiving space;

said stop portion receiving section of said groove of said first housing extending slightly in a direction toward one of said front surface and said rear surface of said first housing, so that a width thereof is slightly greater than that of said stop portion of said adjusting rod;

said limiting section of said groove extending slightly in the same direction at positions close to said first boundary and said second boundary, so that widths at such positions are slightly greater than other portions of said limiting section;

when said adjusting rod is pivoted to one of said first boundary and said second boundary of said groove, said rod body of said adjusting rod is movable in the same direction to abut against said front surface of said first housing to achieve a positioning effect.

11. The electronic device of claim 1, wherein said speaker element set of said speaker includes a cable, said rod body of said adjusting rod being hollow and cylindrical, and said stop portion being hollow and spherical and being in communication with an inner space of said rod body to permit extension of said cable therethrough, said adjusting rod of said speaker being rotatable about an axis of said rod body and being movable within a range of said groove.

12. The electronic device of claim 11, wherein said adjusting rod of said speaker further has a limiting block protruding radially from said stop portion, said groove of said main unit further having a limiting block receiving section in communication with said stop portion receiving section and receiving movably said limiting block therein, said adjusting rod being rotatable about the axis of said rod body relative to said groove within a range where said limiting block does not abut against a wall of said groove.

13. The electronic device of claim 12, wherein:

said limiting section of said groove of said first housing is fan-shaped in cross section, whose width decreases from said opening toward said stop portion receiving section; and said limiting block receiving section is fan-shaped in cross section, with an inwardly decreasing width where the minimum width is at a junction with said stop portion receiving section.

14. The electronic device of claim 12, wherein said limiting block of said adjusting rod of said speaker has two limiting faces extending from said stop portion tangential to a surface of said stop portion and intersecting each other.

15. The electronic device of claim 1, wherein:

said rod body of said adjusting rod is retractable, and has a first rod segment that is hollow and cylindrical and that is mounted to said second housing, and a second rod segment that is hollow and cylindrical, that is telescopically and rotatably connected to said first rod segment and that has an end connected to said stop portion, such that said second housing of said speaker is rotatable about the axis of said rod body; and said first and second rod segments has intervening ends to prevent departing from each other.

16. The electronic device of claim 15, wherein said rod body of said adjusting rod further has a first limiting rib and a second limiting rib respectively protruding from two surfaces of said first and second rod segments that face each other, such that said first rod segment of said rod body is rotatable relative to said second rod segment within a range of non-intervention between said first limiting rib and said second limiting rib.

17. The electronic device of claim 15, wherein:

said speaker element set of said speaker includes a cable;

said first housing of said main unit further has a front surface to allow a display panel to be exposed, and a rear surface opposite to said front surface and connected to said speaker receiving surface;

said stop portion of said adjusting rod being in a shape of a short circular tube perpendicular to said rod body and that extends between said front surface and said rear surface, such that said rod body is pivotable relative to said first housing of said main unit about an axis of said stop portion.

18. The electronic device of claim 17, wherein said first housing has a recessed structure, a side surface, and a speaker receiving surface connected to said side surface and defining said recessed structure, at least said speaker receiving surface defining a receiving space for receiving said speaker, said groove being disposed at a junction of said side surface and said speaker receiving surface, and having a first boundary at said speaker receiving surface and a second boundary at said side surface;

wherein when said second housing of said speaker is received in said receiving space, said rod body of said adjusting rod of said speaker is located at said first boundary of said groove, and as said adjusting rod pivots toward said second boundary, said second housing moves relative to said first housing of said main unit and changes an orientation and is removed from said receiving space;

said stop portion receiving section of said groove of said first housing extending slightly in a direction toward one of said front surface and said rear surface of said first housing, so that a width thereof is slightly greater than that of said stop portion of said adjusting rod;

said limiting section of said groove extending slightly in the same direction at positions close to said first boundary and said second boundary, so that widths at such positions are slightly greater than other portions of said limiting section;

when said adjusting rod is pivoted to one of said first boundary and said second boundary of said groove, said rod body of said adjusting rod is movable in the same direction to abut against said front surface of said first housing to achieve a positioning effect.

19. The electronic device of claim 17, wherein said speaker further includes a pivot axle in a shape of a short circular tube and extending in a front-rear direction of said second housing, said rod body of said adjusting rod being secured inside said second housing by said pivot axle, such that said second housing is pivotable about said pivot axle relative to said rod body.

* * * * *